United States Patent [19]

Ishii

[11] 4,380,758

[45] Apr. 19, 1983

[54] MOTOR ACTUATED BELL

[75] Inventor: Tadashi Ishii, Tokyo, Japan

[73] Assignee: Kobishi Electric Co., Ltd., Tokyo, Japan

[21] Appl. No.: 168,405

[22] Filed: Jul. 10, 1980

[51] Int. Cl.[3] ..... G08B 3/10; G10K 1/064

[52] U.S. Cl. ..... 340/396; 340/399; 340/402

[58] Field of Search ..... 340/392, 396, 399, 402, 340/388; 116/152–164

[56] References Cited

U.S. PATENT DOCUMENTS

| | | | |
|---|---|---|---|
| 195,391 | 9/1877 | Perry | 116/156 |
| 2,474,405 | 6/1949 | Ritti | 340/396 X |
| 3,435,450 | 3/1969 | Pena | 340/396 X |
| 4,183,018 | 1/1980 | Sakaguchi | 340/396 |
| 4,286,259 | 8/1981 | Ishii | 340/396 |

FOREIGN PATENT DOCUMENTS

| | | | |
|---|---|---|---|
| 16895 | 7/1909 | United Kingdom | 340/388 |

*Primary Examiner*—John W. Caldwell, Sr.
*Assistant Examiner*—Daniel Myer
*Attorney, Agent, or Firm*—Darby & Darby

[57] ABSTRACT

A motor actuated bell comprises a crank member operatively connected to a motor drive shaft. An elongated connecting plate is connected at one end thereof to the crank member for being reciprocally moved along its axis. A pivotal lever is connected at one end thereof generally perpendicularly to the other end of said connecting plate for being subjected to swinging movement. A hammer means has a resilient means resiliently supporting a hammer element on the lever.

1 Claim, 6 Drawing Figures

MOTOR ACTUATED BELL

BACKGROUND OF THE INVENTION

1. Field of the Invention

This invention relates generally to motor actuated bells and more particularly to motor actuated bells of the type in which a motor drives a hammer means through a transmission means to allow the same to strike against an associated gong with substantial impact to thereby produce bell sound of great volume.

2. Prior Art

One conventional motor actuated bell, as shown in FIG. 1, comprises a small DC motor 100 having a drive shaft 101 on which a gear 102 is fixedly mounted, a wheel gear 103 fixedly mounted on a shaft 104 and engaging the gear 102, and a cam 105 mounted on the shaft 104. With this construction, the motor 100 is driven to rotate the cam 105 through the meshed gears 102, 103 so that the cam intermittently acts on the end of a hammer 106 to allow the same to strike against an associated gong against the bias of a coil spring 107 to produce bell sound. This known motor driven bell has been found not entirely satisfactory in that the motor need to provide a substantial torque to enable the hammer to strike against the gong with substantial impact to produce bell sound of great volume.

SUMMARY OF THE INVENTION

It is therefore an object of this invention to provide a motor actuated bell of the type which is capable of producing bell sound of substantial volume without the need for a great motor torque.

According to the present invention, there is provided a motor actuated bell which comprises

- a base;
- a gong mounted on the base;
- a motor mounted on the base and having a rotatable drive shaft;
- a crank member operatively connected to the motor drive shaft;
- an elongated connecting plate connected at one end thereof to the crank member for being reciprocally moved along its axis;
- a lever pivotally mounted on the base and connected at one end thereof generally perpendicularly to the other end of the connecting plate for being subjected to swinging movement;
- a hammer means having a hammer element for striking against the gong, the hammer means having a resilient means resiliently supporting the hammer element on the lever.

Other advantages, features and additional objects of the present invention will become manifest to those versed in the art upon making reference to the detailed description and the accompanying sheets of drawings in which preferred embodiments incorporating the principles of the present invention are shown by way of illustrative examples.

DESCRIPTION OF THE PREFERRED EMBODIMENTS OF THE INVENTION

Figure 1:
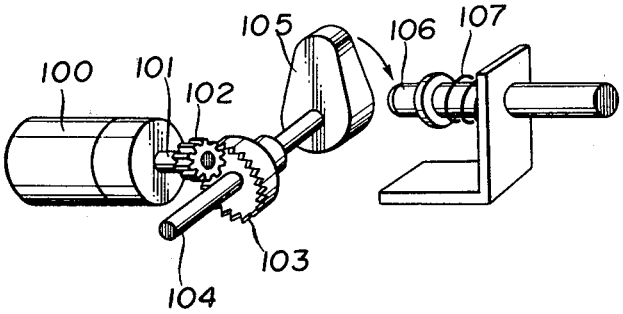
Fig. 1 (Prior Art)
FIG. 1 is a schematic perspective view of a motor actuated bell constructed in accordance with the prior art.
Figure 2:
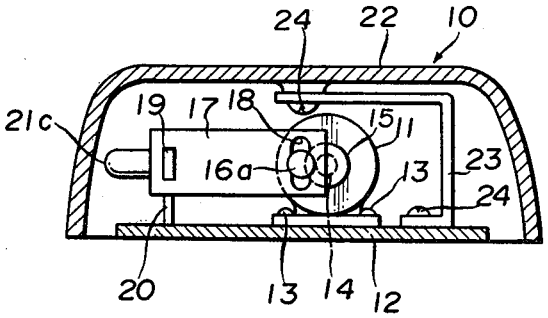
FIG. 2 is a cross-sectional view of a motor actuated bell provided in accordance with the present invention.
Figure 3:
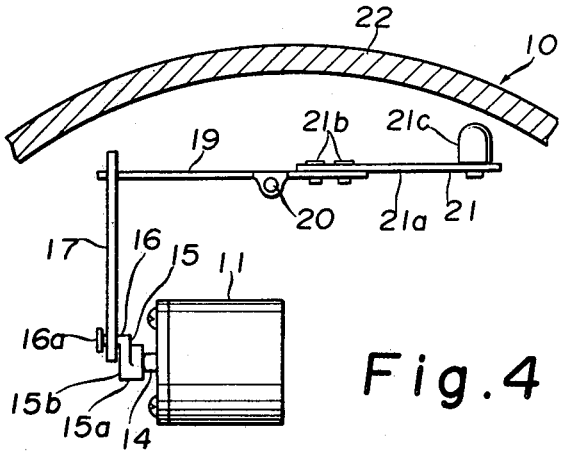
FIG. 3 is a schematic plan view of the bell.

FIGS. 2 and 3 show a motor actuated bell 10. An electric motor 11 is fixedly mounted on a mounting plate or base 12 by screws 13, the motor having a drive shaft 14 extending from the motor body in parallel spaced relationship to the mounting plate 12. A crank member 15 is fixedly mounted on the motor drive shaft 14 for rotation therewith, the crank member having a cylindrical body **15*a* and an eccentric pin 16 formed integral with the body. The eccentric pin 16 is disposed in eccentric or offset relation to the axis of the drive shaft 14. An elongated connecting plate 17 of a rectangular shape has a slot 18 formed therethrough at one end thereof and extending widthwise, i.e., perpendicularly to its longitudinal axis, the connecting plate 17 being disposed in parallel spaced relation to the mounting plate 12. The eccentric pin 16 is loosely received in the slot 18, the pin having an enlarged head 16*a* for preventing the connecting plate 17 from becoming disengaged therefrom. A rigid lever 19, which is made, for example, of a rigid synthetic resin, is pivotally mounted intermediate opposite ends thereof on a post 20 which extends perpendicularly from the mounting plate 12, the lever 19 being disposed in parallel spaced relationship to the mounting plate 12. The lever 19 is rigidly connected at one end thereof to the end of the connecting plate 17 remote from the eccentric pin 16, the lever 19** extending through the connecting plate and intersecting the same substantially perpendicularly.

A hammer means 21 comprises a leaf spring **21*a* secured at one end thereof by rivets 21*b* to the end of the lever 19 remote from the connecting plate 17, and a hammer element 21*c* secured to the other end of the leaf spring 21*a***.

As shown in FIG. 3, the length of the eccentric pin 16 between the inner face of the head **16*a* and the end face 15*b* of the cylindrical crank body 15*a* is greater than the thickness of the connecting plate 17 to permit a slight lateral movement of the plate 17**.

As shown in FIG. 2, the mounting plate 12 is arranged within and connected to an inverted cup-shaped gong or bell 22 by a connecting member 23 of a generally channel-shaped cross-section, the connecting member 23 being fixedly secured to the mounting plate 12 and the gong 22 by screws 24.

In operation, the motor 11 is first driven through a power source (not shown) to rotate the crank member 15 in a clockwise direction (FIG. 2) to allow the eccentric pin 16 to revolve around the drive shaft 14. During a first half of revolution of the pin 16, the pin, which is disposed on the left side of the drive shaft 14 (FIG. 2) with its axis and the axis of the drive shaft 14 lying in a common plane parallel to the mounting plate 12, is angularly moved through 180° so that the pin 16 is held in sliding contact with the right side edge of the slot 18 to move the connecting plate 17 in a right-hand direction. The thus moved connecting plate 17 allows the lever 19 to pivot about the post 20 so that the hammer element **21*c* is caused to strike against the inner wall of the gong 22 at the end of the above-mentioned angular movement to produce bell sound. During the other half of revolution of the eccentric pin 6, the pin is angularly moved through 180° so that the pin 16 is held in slidig contact with the left side edge of the slot 18 to move the connecting plate 17 in a left-hand direction. The thus moved connecting plate 17 allows the lever 19 to pivot about the post 20 so that the hammer element 21c is moved away from the gong 22**.

This cycle of operation is continuously repeated to impart a swinging motion to the hammer means 21 so as to produce bell sound of the required volume. When the hammer means 21 is moved to its fully retracted position from the gong 22, the leaf spring 21a is slightly flexed in a direction away from the gong so that the restoring force of the thus flexed leaf spring 21a enhances the striking of the hammer element 21c against the gong 22.

Figure 4:
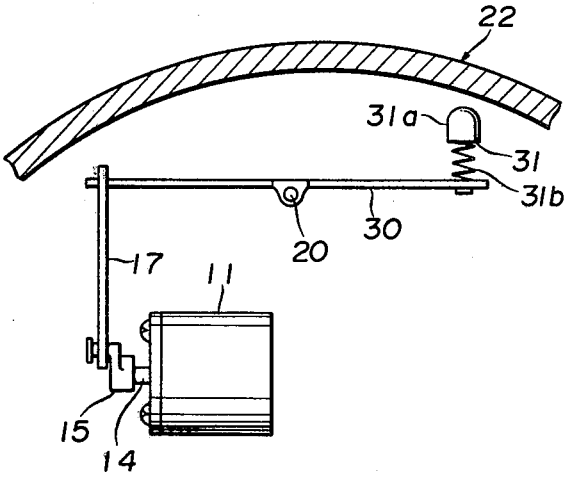
FIGS. 4 to 6 are views similar to FIG. 3 but showing modified bells.

According to a modified form of the invention shown in FIG. 4, a rigid lever 30 is pivotally mounted on the post 20 approximately centrally of the length thereof. The lever 30 has a hammer means 21 secured to its free end remote from the connecting plate 17, the hammer means comprising a hammer element 31a and a resilient means 31b in the form of a coil spring interconnecting the hammer element 31a and the lever 30. A mode of operation of this modified bell is substantially similar to that of the bell 10 shown in FIGS. 2 and 3. When the hammer means 31 is moved to its fully retracted position from the gong 22, the coil spring 31b is axially contracted so that the restoring force of the thus contracted coil spring 31b may enhance the striking of the hammer element 31a against the gong 22 depending on the spring constant of the coil spring 31b and the speed of rotation of the motor drive shaft 14.

Figure 5:
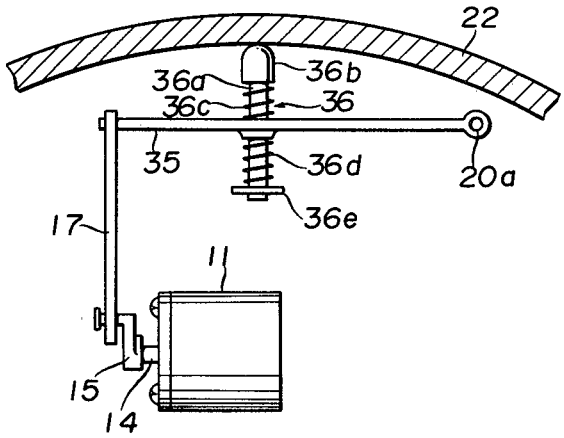

FIG. 5 shows another modification in which a rigid lever 35 is pivotally mounted on a post 20a at one end thereof remote from the connecting plate 17. The lever 35 has a hammer means 36 mounted thereon intermediate its opposite ends. The hammer means 36 comprises an elongated hammer element 36a of a cylindrical shape having a head 36b and slidably received in a hole (not shown) formed through the lever 35, and a pair of coil spring 36c, 36d wound around the hammer element 36a on opposite sides of the lever 35. A collar 36e is fixedly mounted on the end of the hammer element 36a remote from the hammer head 36b. The coil spring 36c acts between the hammer head 36b and the lever 35 while the coil spring 36d acts between the collar 36e and the lever 35. When the motor 11 is driven, the lever 35 is pivotally moved about the post 20a toward and away from the gong 22 through the crank member 15 and the connecting plate 17 so that the hammer head 36b is caused to strike against the gong 22 to produce bell sound. When the hammer element 36a is moved to its fully retracted position from the gong 22, the coil spring 36c is axially contracted so that the restoring force of the thus contracted coil spring 36c may enhance the striking of the hammer head 36b against the gong 22 depending on the spring constant of the coil spring 36c and the speed of rotation of the motor drive shaft 14.

Figure 6:
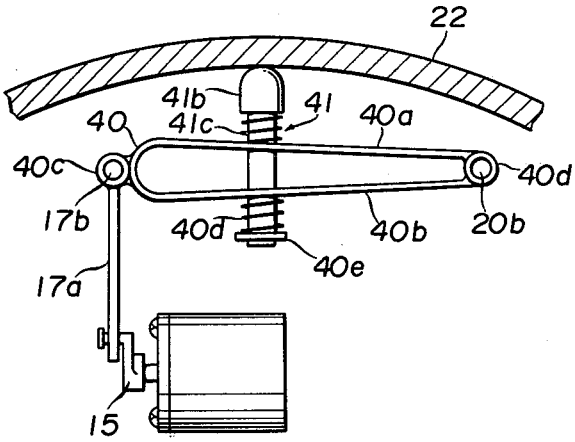

According to a further modification of the invention shown in FIG. 6, a rigid lever 40 of a generally elongated oval shape has a pair of spaced arms 40a, 40b and a pair of ring portions 40c, 40d at its opposite ends. A connecting plate 17a has an integral pin 17b at one end thereof remote from the crank member 15. The pin 17b and an upstanding post 20b are received in the ring portions 40c, 40d, respectively, so as to provide a pivotal connection. A hammer means 41, which is identical in construction to the hammer means 36 shown in FIG. 5, is mounted on the lever 40 intermediate opposite ends thereof, and a hammer element 41a extends through the arms 40a, 4b for sliding movement along its axis. A coil spring 41c acts between a hammer head 41b and the arm 40a while a coil spring 41d acts between the arm 40b and a collar 41e.

As described above, the resilient means in the form of a leaf spring or coil springs associated with the hammer element aids in imparting sufficient momentum to the hammer element to allow the same to strike against the gong with substantial impact so that the bell sound of great volume can be produced.

While the motor actuated bells according to this invention have been specifically shown and described herein, the invention itself is not to be restricted by the exact showing of the drawings or the description thereof. For example, a speed reducer may be connected to the motor drive shaft to actuate the hammer at a lower speed.

What is claimed is:

1. A motor actuated bell which comprises:

(a) a gong;

(b) a base mounted with said gong;

(c) a motor mounted on said base and having a rotatable drive shaft;

(d) a crank member fixedly secured to said motor drive shaft for rotation therewith, said crank member having an eccentric pin extending away from said motor in eccentric relation to the axis of said motor drive shaft;

(e) a rectangular connecting plate disposed generally in parallel relation to said base and lying in a plane generally perpendicular to the axis of said eccentric pin, said connecting plate having a slot formed therethrough at one end thereof and extending perpendicular to the longitudinal axis thereof, and said eccentric pin being received in said slot for sliding movement therealong, whereby said connecting plate is reciprocally moved along its axis through said eccentric pin upon rotation of said motor drive shaft;

(f) a rigid lever pivotally mounted on said base intermediate opposite ends thereof, said lever being fixedly secured at one end thereof generally perpendicularly to the other end of said connecting plate for swinging movement in parallel spaced relation to said base; and (g) a hammer means having a hammer element for striking against the inner wall of said gong, said hammer means having a leaf spring fixedly secured at one end thereof to the other end of said lever and extending therefrom along the axis of said lever, and said leaf spring carrying said hammer element at the other end thereof.

* * * * *